US012590422B2

(12) United States Patent
Makovsky

(10) Patent No.: US 12,590,422 B2
(45) Date of Patent: Mar. 31, 2026

(54) RAILROAD TIE HANDLER

(71) Applicant: Brandon J. Makovsky, Prentice, WI (US)

(72) Inventor: Brandon J. Makovsky, Prentice, WI (US)

( * ) Notice: Subject to any disclaimer, the term of this patent is extended or adjusted under 35 U.S.C. 154(b) by 875 days.

(21) Appl. No.: 17/837,403

(22) Filed: Jun. 10, 2022

(65) Prior Publication Data

US 2022/0396920 A1 Dec. 15, 2022

Related U.S. Application Data

(60) Provisional application No. 63/210,113, filed on Jun. 14, 2021.

(51) Int. Cl.

| | |
|---|---|
| ***E01B 29/10*** | (2006.01) |
| ***E01B 29/09*** | (2006.01) |
| ***E01B 29/16*** | (2006.01) |

(52) U.S. Cl.

CPC ..... *E01B 29/10* (2013.01); *E01B 29/09* (2013.01); *E01B 29/16* (2013.01)

(58) Field of Classification Search

CPC ..... E01B 29/04; E01B 29/06; E01B 29/09; E01B 29/10; E01B 29/16

USPC ..... 104/6, 7.1, 9

See application file for complete search history.

(56) References Cited

U.S. PATENT DOCUMENTS

| | | | | | |
|---|---|---|---|---|---|
| 3,698,324 | A | * | 10/1972 | Peppin | E01B 29/10 104/9 |
| 3,780,664 | A | * | 12/1973 | Holley | E01B 29/10 104/9 |
| 3,948,185 | A | | 4/1976 | Settle et al. | |
| 4,127,070 | A | | 11/1978 | Dieringer et al. | |
| 4,133,266 | A | | 1/1979 | Taylor | |
| 4,392,433 | A | | 7/1983 | Nyland | |
| 4,579,060 | A | | 4/1986 | Nameny et al. | |
| 4,770,103 | A | * | 9/1988 | Allmer | E01B 29/10 104/9 |
| 4,955,301 | A | | 9/1990 | Theurer et al. | |
| 5,025,733 | A | | 6/1991 | Pierobon | |
| 5,119,723 | A | * | 6/1992 | Lovitt, Jr. | E01B 29/10 104/9 |
| 5,305,692 | A | * | 4/1994 | Madison | E01B 29/10 294/902 |
| 5,395,692 | A | | 3/1995 | White et al. | |
| 5,651,317 | A | * | 7/1997 | Kim | E01B 29/10 104/9 |
| 5,722,325 | A | | 3/1998 | Glomski et al. | |

(Continued)

*Primary Examiner* — Zachary L Kuhfuss
(74) *Attorney, Agent, or Firm* — Shewchuk IP Services, LLC; Jeffrey D. Shewchuk

(57) ABSTRACT

A hydraulically powered railroad tie handler can be attached to a crane on the rear of a truck which can travel either over rails or over pavement. The tie handler has seven hydraulic functions: clamping a main body to underlying rails, gripping a new or old railroad tie, stroking to move the gripped tie laterally under the rails, pivoting the stroker relative to the main body of the tie handler angle the stroker path relative to the main body, tilting of the gripper head relative to the stroker, pivoting the main body to change its angle with respect to the crane attachment plate; and lifting of the main body and clamped rails by pushing off ground between the rails. The stroker extends between two spaced plate portions of the main body.

20 Claims, 11 Drawing Sheets

(56) References Cited

U.S. PATENT DOCUMENTS

| | | | | |
|---|---|---|---|---|
| 6,463,858 | B2 | 10/2002 | Weber et al. | |
| 6,640,726 | B2 | 11/2003 | Theurer et al. | |
| 6,755,135 | B2 | 6/2004 | Johnsen et al. | |
| 7,287,476 | B2 * | 10/2007 | Durbano | B66C 1/64 104/2 |
| 8,863,667 | B1 | 10/2014 | Irion | |
| 9,038,541 | B2 | 5/2015 | Irion | |
| 9,683,333 | B2 | 6/2017 | Straub et al. | |
| 9,850,624 | B2 * | 12/2017 | Schrunk, III | E01B 29/10 |
| 2016/0032534 | A1 * | 2/2016 | Steck | E01B 31/04 83/167 |

* cited by examiner

RAILROAD TIE HANDLER

CROSS-REFERENCE TO RELATED APPLICATION(S)

The present application claims the benefit of U.S. provisional patent application Ser. No. 63/210,113, filed Jun. 14, 2021, entitled "Railroad Tie Handler". The contents of U.S. provisional patent application Ser. No. 63/210,113 are hereby incorporated by reference in entirety.

BACKGROUND OF THE INVENTION

The present invention is directed to the field of right of way clearing and track maintenance for railroad tracks, typically involving two parallel steel rails secured on top of a series of perpendicular wooden ties. The ties, also referred to as "cross-ties" or "sleepers", are commonly positioned in a crushed stone or gravel ballast roadbed which is packed between and below the ties. The rails are secured to the tops of the ties by tie plates which spread the load between the rails and the ties, typically with spikes that are driven through spike holes of the tie plates and into the wooden ties. A typically ties size is roughly rectangular and 7×9 inches in cross-section, and about 102 inches long, supporting rails which are spaced 56.6 inches apart on the inner side edges of the rails. Occasionally the ties can alternatively be made of concrete, metal or composite material. Ties are typically spaced with a center on center spacing of about 19.5 inches.

Over time and with exposure to the elements, ties may become worn or deteriorate to the point where the spikes are only weakly held in the tie or the tie plate is not adequately supported. Seasonal wet/dry and freeze/thaw cycles can cause wooden ties to develop splits, which can progress and widen over time. Fungal decay can break down exposed wood fibers. Repeated axle loads from rail traffic contribute to break down of wood fibers beneath the tie plate. Ties can also become broken, damaged or burned during the course of service. Accordingly, railroad ties that have degraded routinely need replacement.

One current method of tie replacement involves use of a tandem axle truck fitted with a railroad accessory package that allows the truck to travel on rail. This truck also has a rear mounted knuckle boom loader with a double jaw grapple that is used to dislodge and pull a tie out from under the rail after laborers have removed all gauge and plate spikes from the tie plates. A laborer can remove the plate spikes from one of the old ties, with the double jaw grapple being controlled to lift one of the rails so the laborer can slide the tie plate out from under the rail. The hydraulic force of the double jaw grapple can then be used to pinch an end of the old tie first toward one of the rails and then toward the other rail to slide the old tie laterally out from under the rails. The double jaw grapple can thereafter be used to position a replacement tie under the rail, first placing just an end of the replacement tie under one of the rails, and then manipulating the double jaw grapple like a sledge hammer to push the replacement tie under the rail. Once sufficiently hammered under a rail, the hydraulic force of the double jaw grapple can be used pinching an end of the replacement tie toward the rail and further to the left until the replacement tie is in the desired position. After the replacement tie is in the desired position, plates can be positioned between the replacement tie and the rails (perhaps with the assistance of the double jaw grapple lifting up on a rail), and then spikes driven back through the plate into the replacement tie (perhaps using a jackhammer, not shown). Current production is approximately 35 ties per day replaced with ties, plates, and spikes back in place. This 35 tie per day rate is somewhat driven and/or limited by the skill of the knuckle boom loader operator, with other worker(s) only being active during limited time periods while the double jaw grapple is being positioned and manipulated.

Such equipment for tie replacement has the benefit of having other uses, with the tandem axle truck also being able to be driven with its tires over pavement, and with the knuckle boom loader and double jaw grapple having many alternative construction uses beyond railroad maintenance. In particular, the truck/loader/grapple combination can be used for many other purposes in winter seasons or whenever railroad maintenance is not a priority. The tandem axle truck can be purchased as a relatively high volume, standard use, mass-production vehicle, significantly reducing its price and making maintenance and finding replacement parts much more convenient. Better equipment, which would require less skill of the knuckle boom loader operator and/or result in faster tie removal and replacement, is needed.

Many other types of dedicated equipment for railroad tie replacement are known. For most such prior art equipment, the vehicle is entirely dedicated to railroad tie replacement. Often times, the vehicle is driven on the railroad track to a location directly over the railroad tie being replaced, with the railroad tie handling apparatus being located behind the front wheels and in front of the rear wheels of the vehicle. While the frame of the vehicle between the front and rear wheels is a convenient location for mounting hydraulic equipment, the weight of the vehicle can add load to the rails and underlying ties making removal and replacement of a single tie directly under the vehicle more difficult. Even if the railroad tie replacement apparatus is mounted off the front or rear of the vehicle rather than between the wheels, the frame of the vehicle or the attachment structure to the vehicle can limit flexibility in deciding which direction (to the right or left of the tracks) to use for removal and replacement of each tie. Alignment of the prior art tie handling equipment, so the removal and insertion forces on the tie are properly positioned and aligned, is often difficult and problematic. Even with proper positioning, many types of prior art tie handling equipment does not include proper structure and power for easiest removal and insertion of the ties. Cost of the prior art tie handling equipment is often exorbitant. Better solutions are needed.

SUMMARY OF THE INVENTION

The present invention is a railroad tie handler, which can be provided as an integral part of a dedicated vehicle or as an aftermarket attachment for a vehicle, as well as a method of using the railroad tie handler. The tie handler has a main body with a tie gripper, with the tie gripper being able to selectively grip or release a railroad tie. A rail clamp toward the bottom of the main body allows the main body to be clamped to the rails of a railroad section. The tie gripper is movable via a stroker that allows the tie gripper to be selectively extended or retracted relative to the main body, allowing an operator to remove an old tie underlying the rail or insert a new tie into the space previously occupied by the old tie. The main body in one aspect is pivotally attached below a crane rotator mount, which especially facilitates use of the tie handler in picking up (or releasing) ties on a slope adjacent the track. In another aspect, the main body includes two plate portions, with the stroker extending between the two spaced plate portions of the main body so the two spaced plate portions of the main body protect the stroker. In another aspect, a method of using the tie handler involves transversely moving a tie under the rails while a lifter of the tie handler raises the clamped rails by pushing downwardly against a ground location underneath and between the rails.

BRIEF DESCRIPTION OF THE DRAWINGS

The present invention is described with reference to the attached drawing sheets, in which.

While the above-identified drawing figures set forth a preferred embodiment, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION OF THE PREFERRED EMBODIMENT(S)

Figure 1:
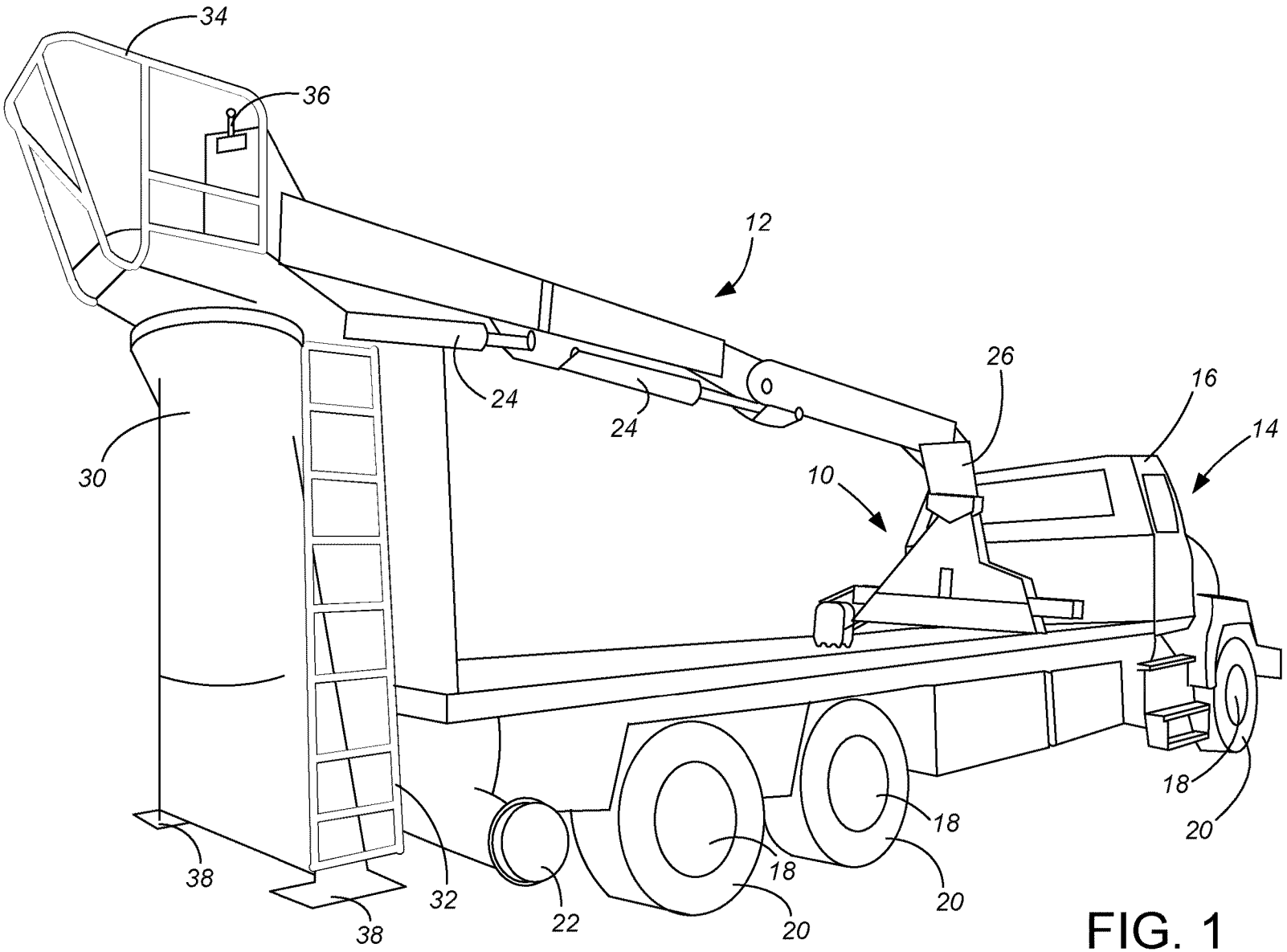
FIG. 1 is a rear perspective view of a tandem axle truck and crane outfitted with a preferred railroad tie handler in accordance with the present invention, with the tie gripper extending to the left, and with the truck configured for driving on pavement.
Figure 2:
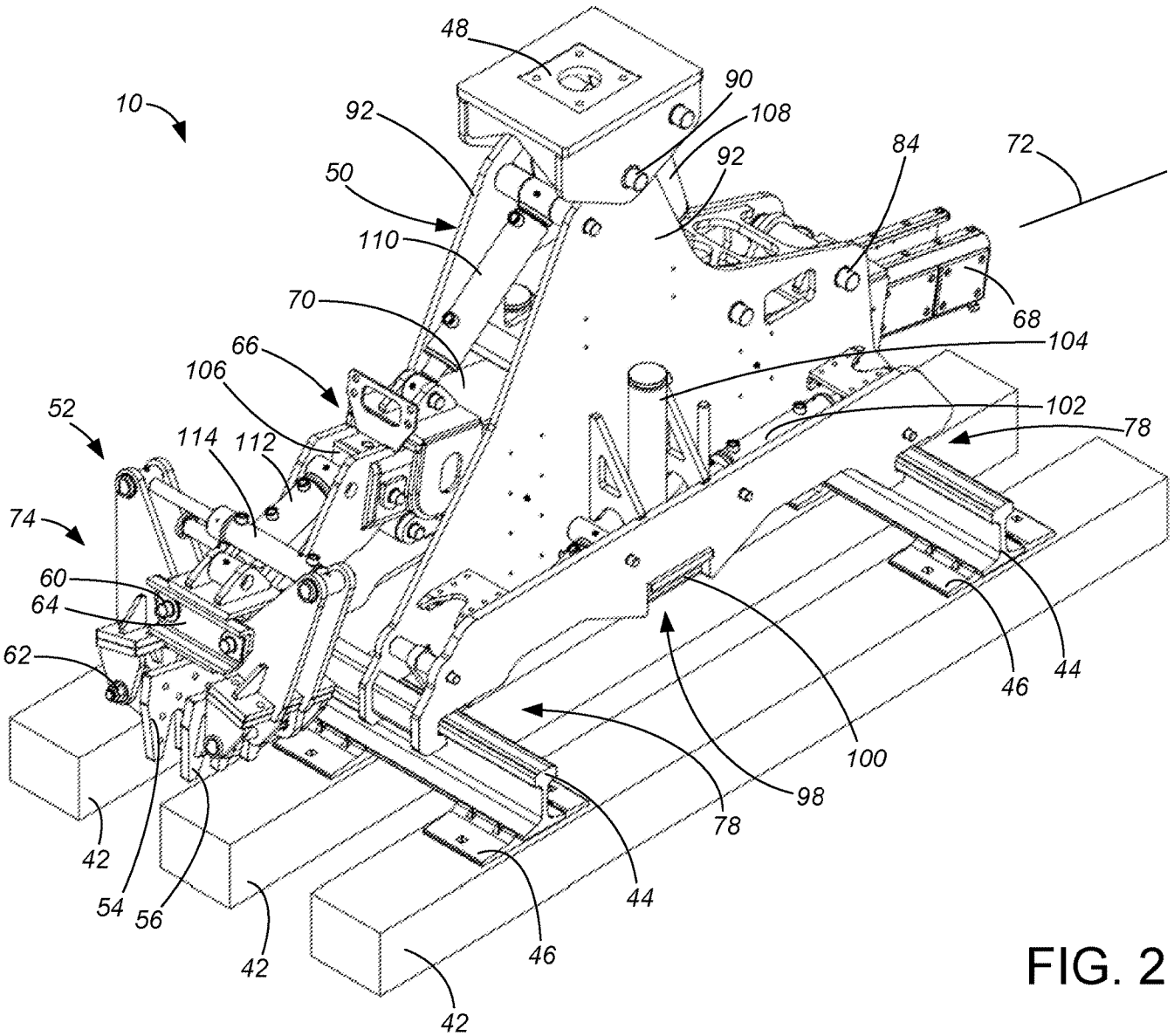
FIG. 2 is a rear perspective view of the railroad tie handler of FIG. 1, with the tie gripper extending to the left, not showing the crane or truck, but showing a short section of track.
Figure 3:
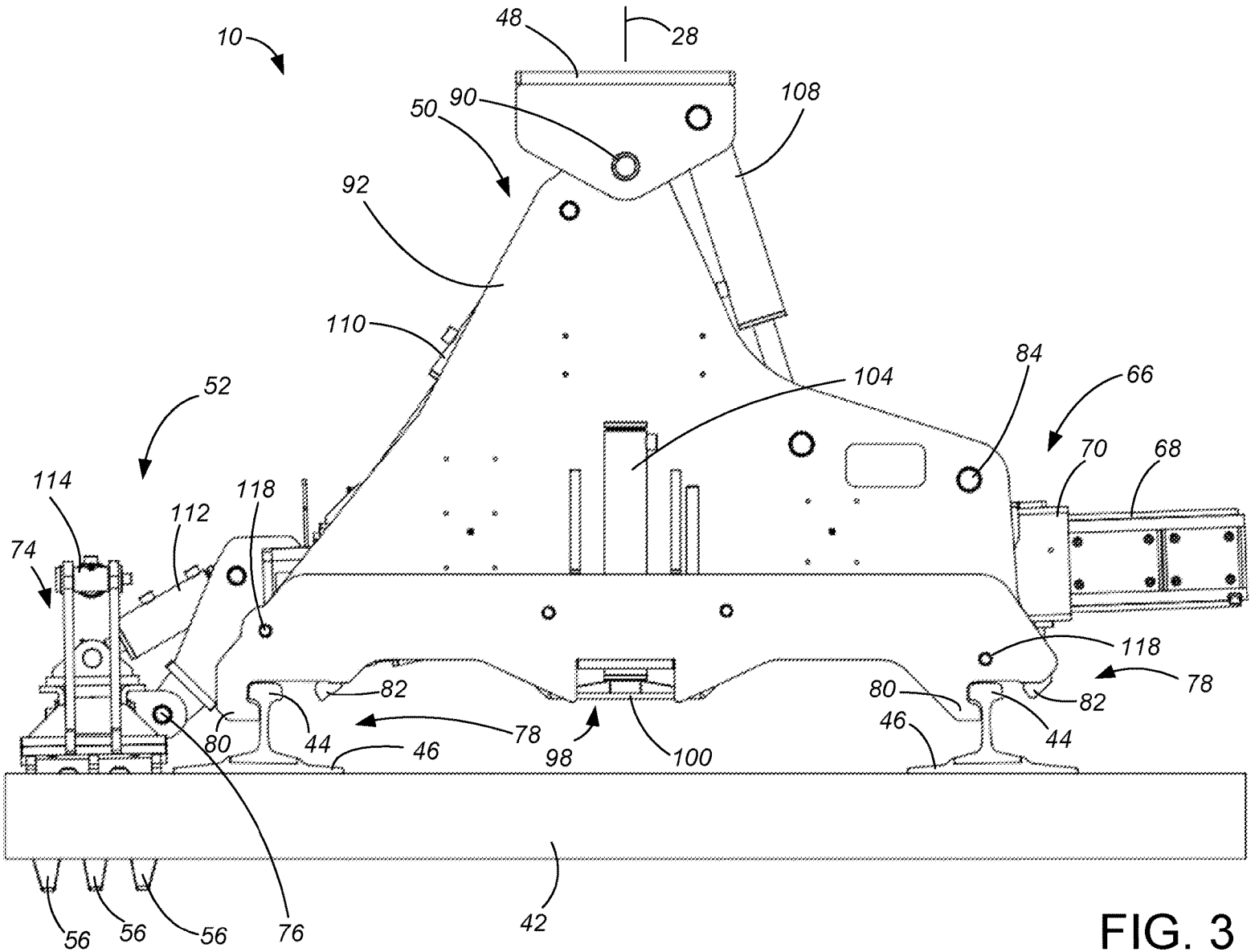
FIG. 3 is a rear elevation view of the railroad tie handler of FIGS. 1 and 2, with the tie gripper extending to the left while gripping a tie, not showing the crane or truck.
Figure 4:
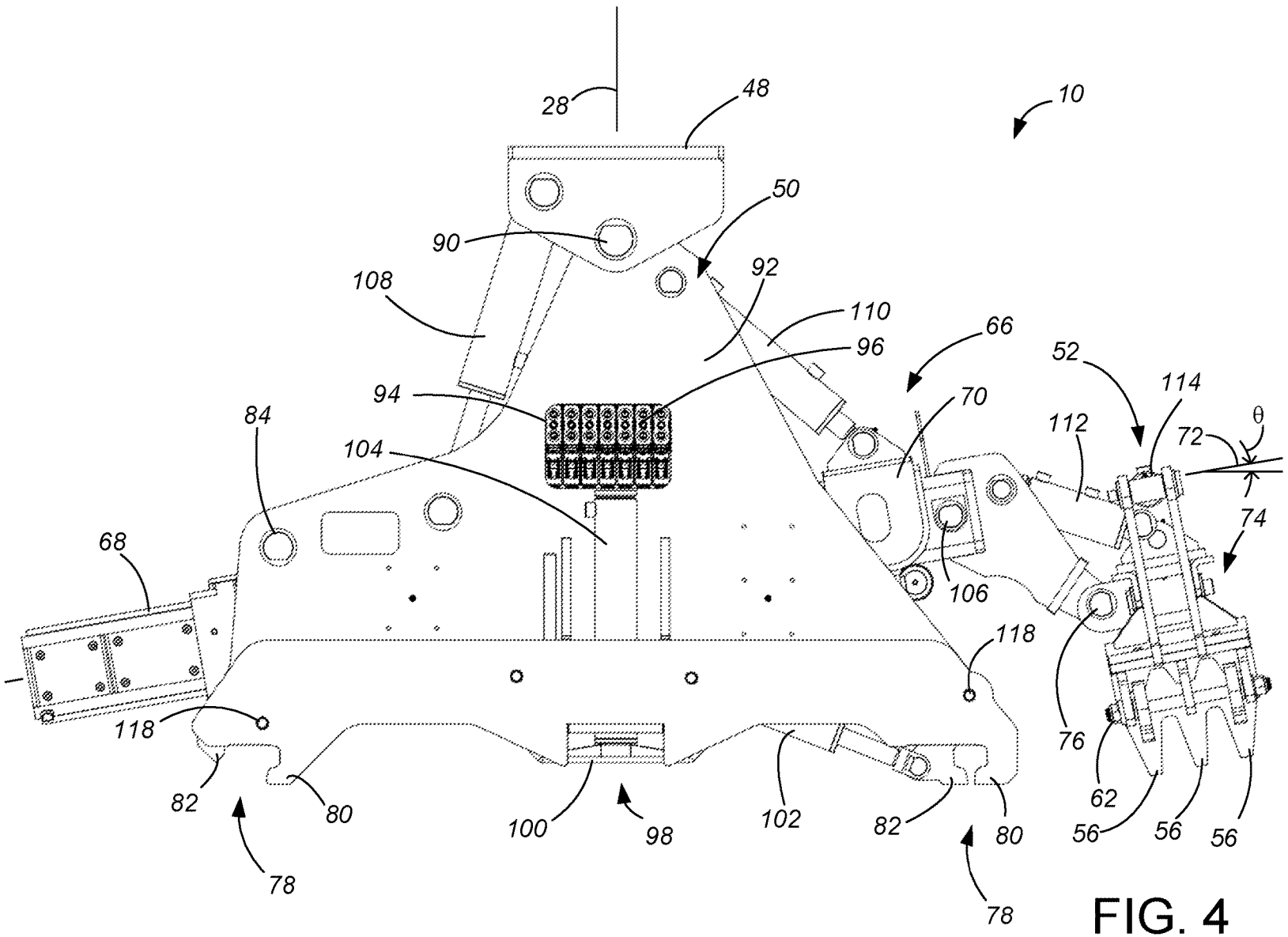
FIG. 4 is a front elevation view of the railroad tie handler of FIGS. 1-3, with the tie gripper slightly extended and raised, not showing the crane or truck.
Figure 5:
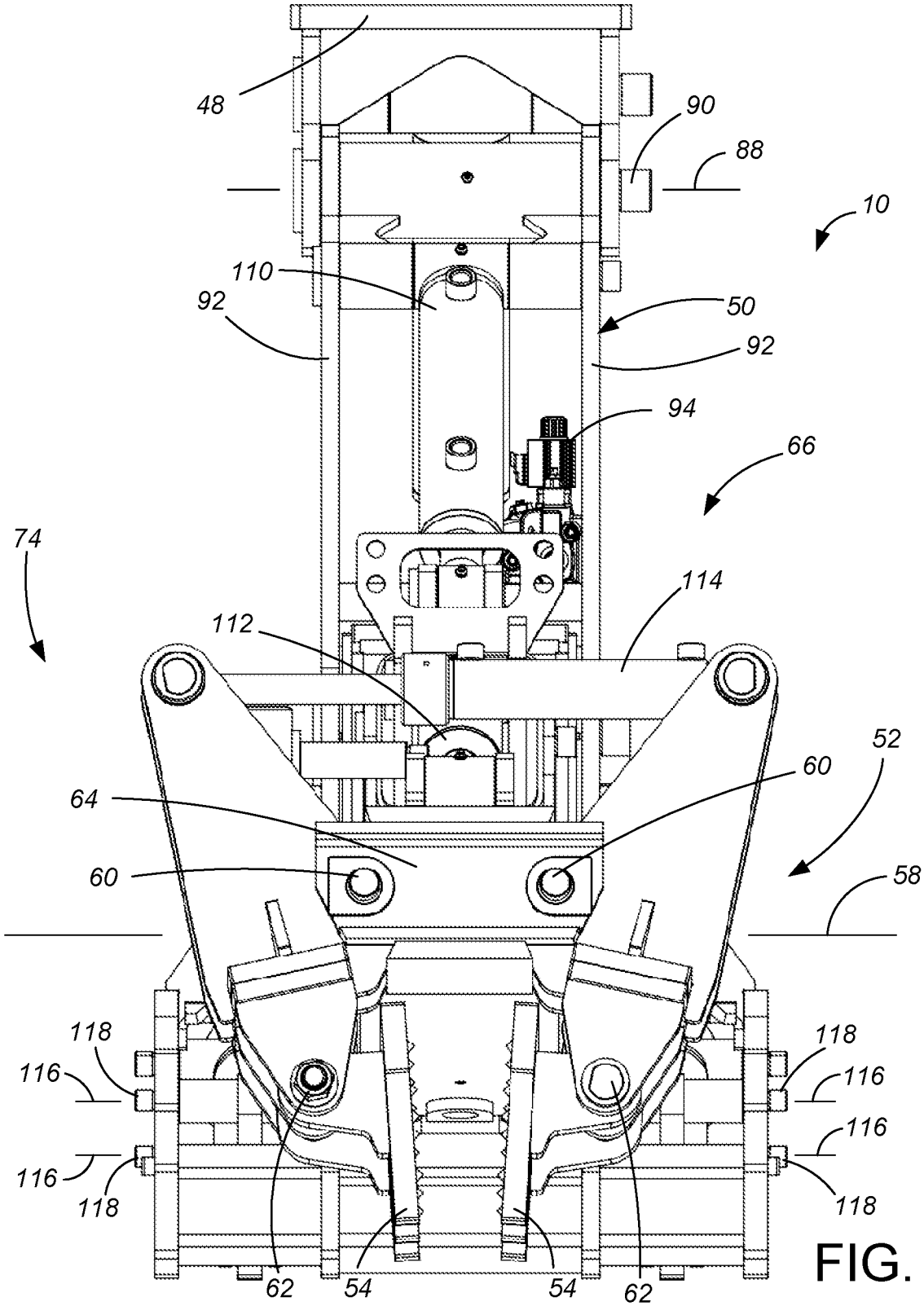
FIG. 5 is a side elevation view of the railroad tie handler of FIGS. 1-4 from the tie gripper side.
Figure 6:
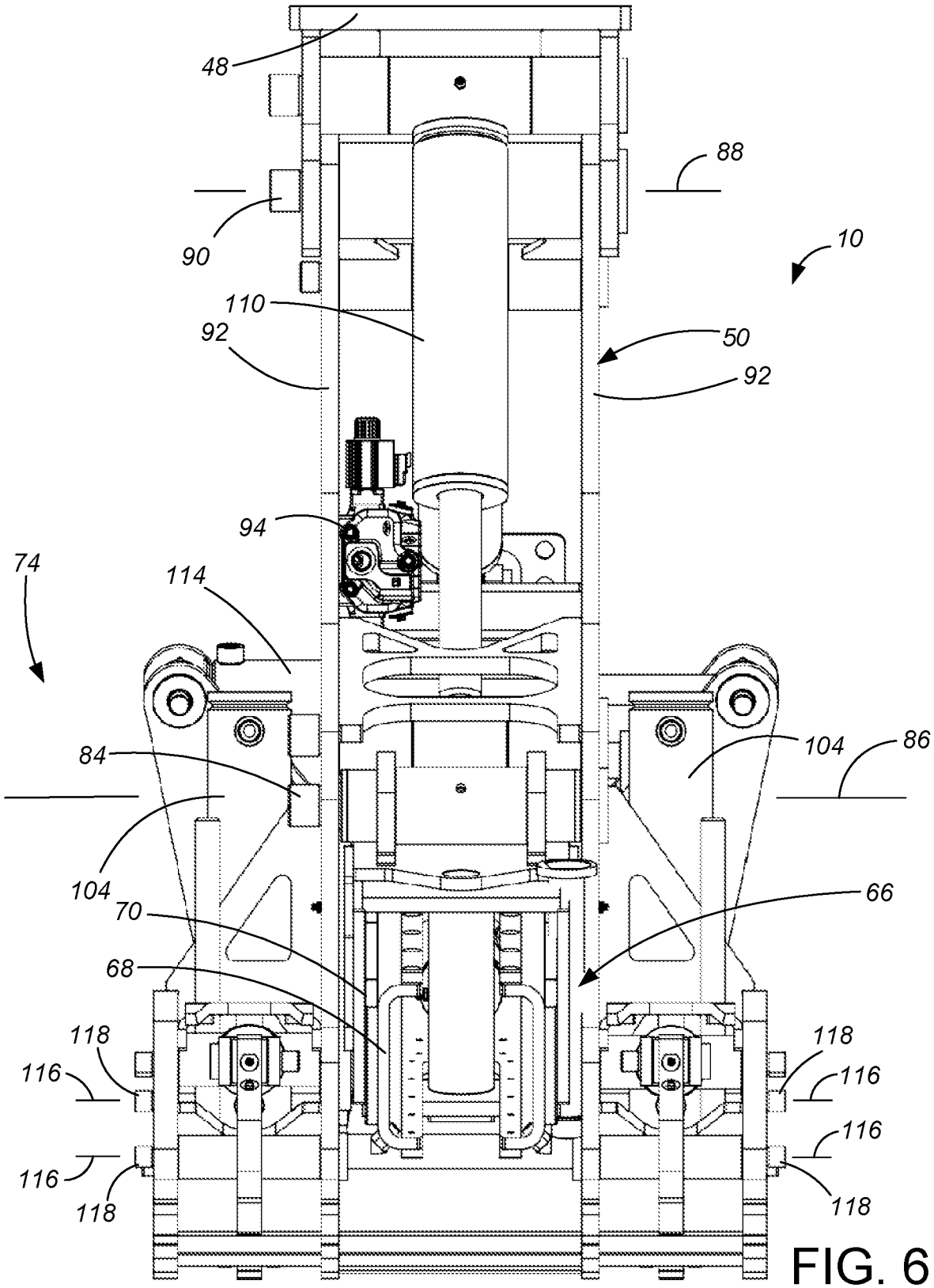
FIG. 6 is a side elevation view of the railroad tie handler of FIGS. 1-5 from the stroker box side.
Figure 7:
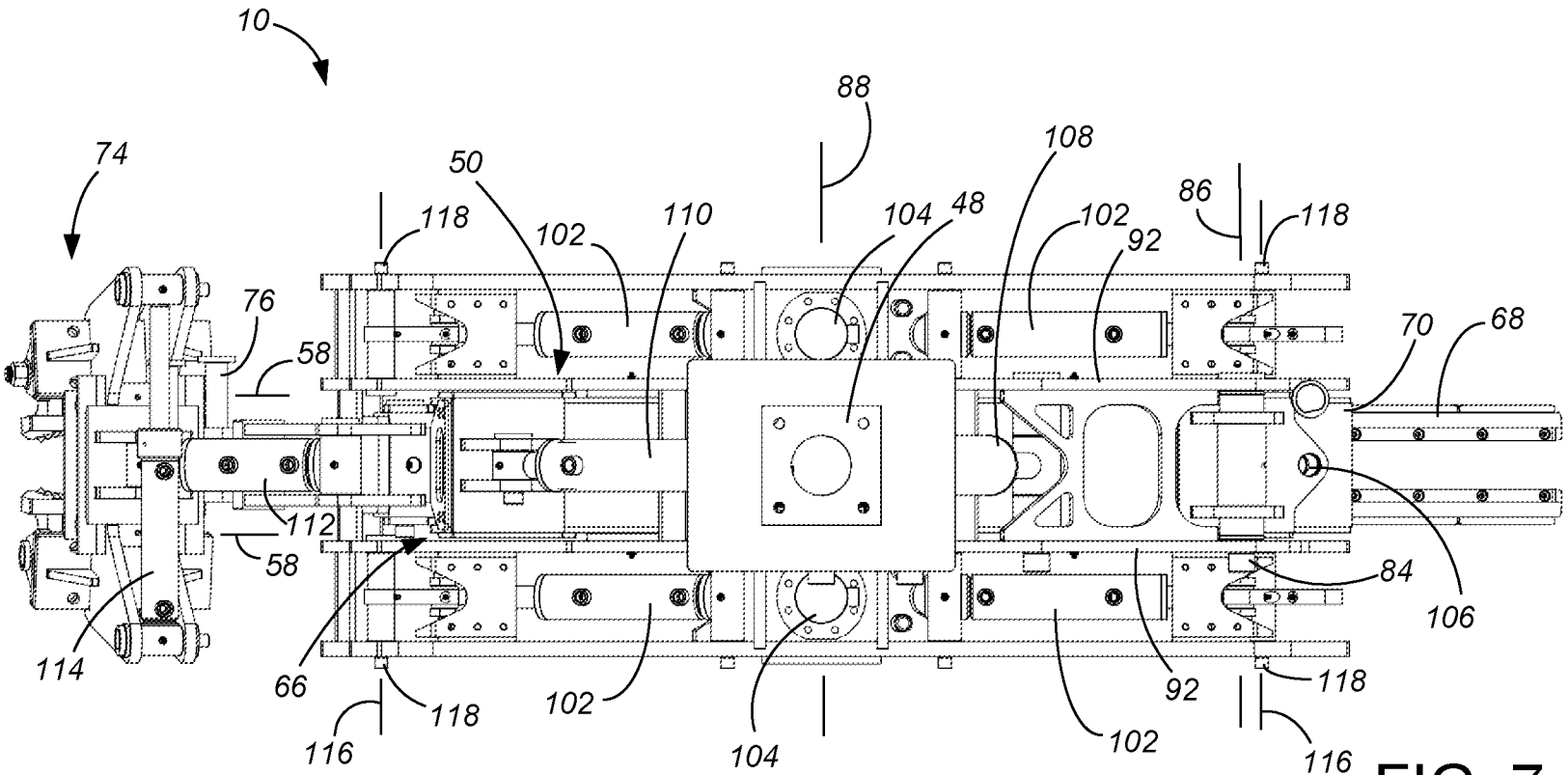
FIG. 7 is a top plan view of the railroad tie handler of FIGS. 1-6.
Figure 8:
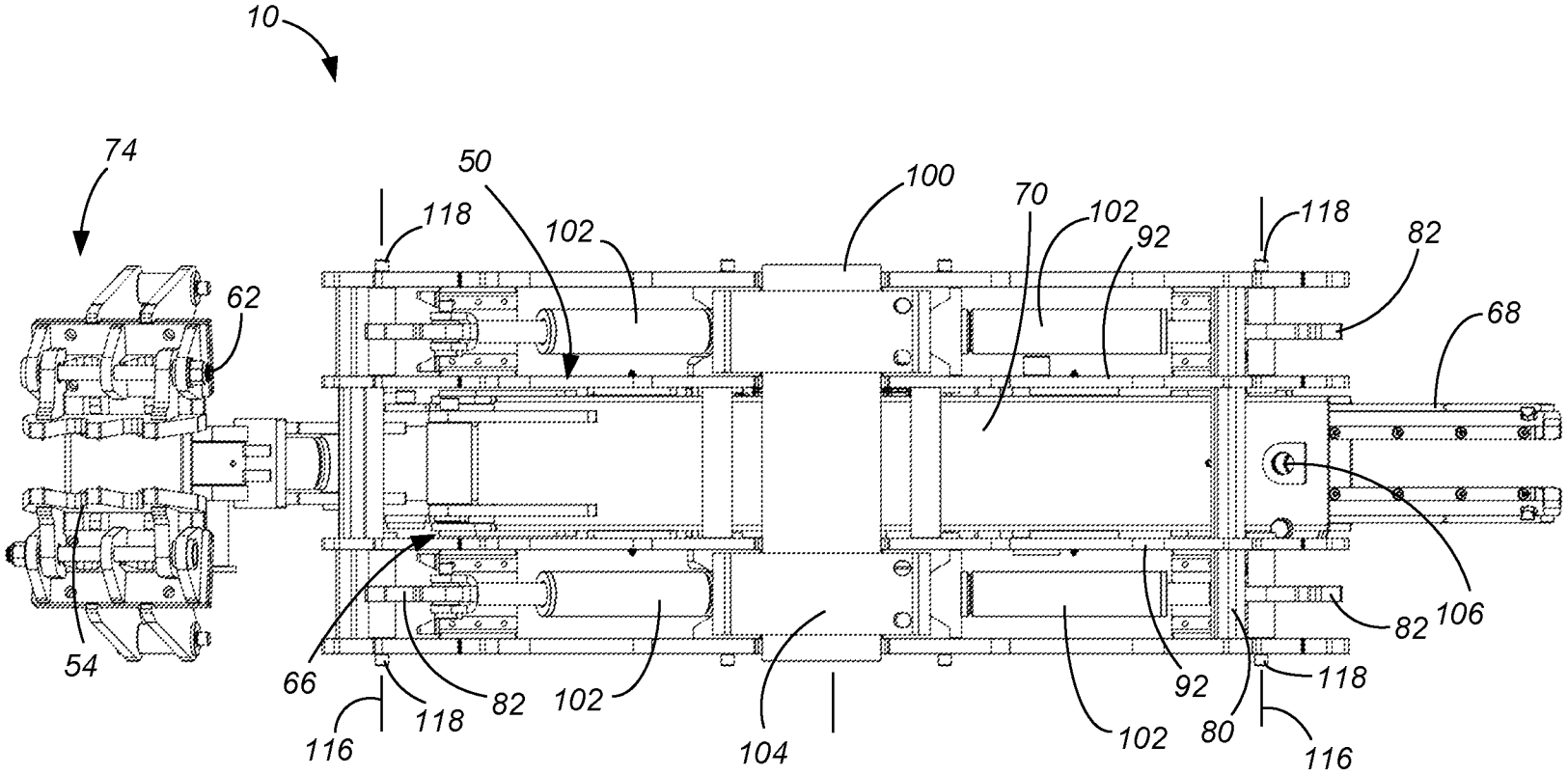
FIG. 8 is a bottom plan view of the railroad tie handler of FIGS. 1-7.
Figure 9:
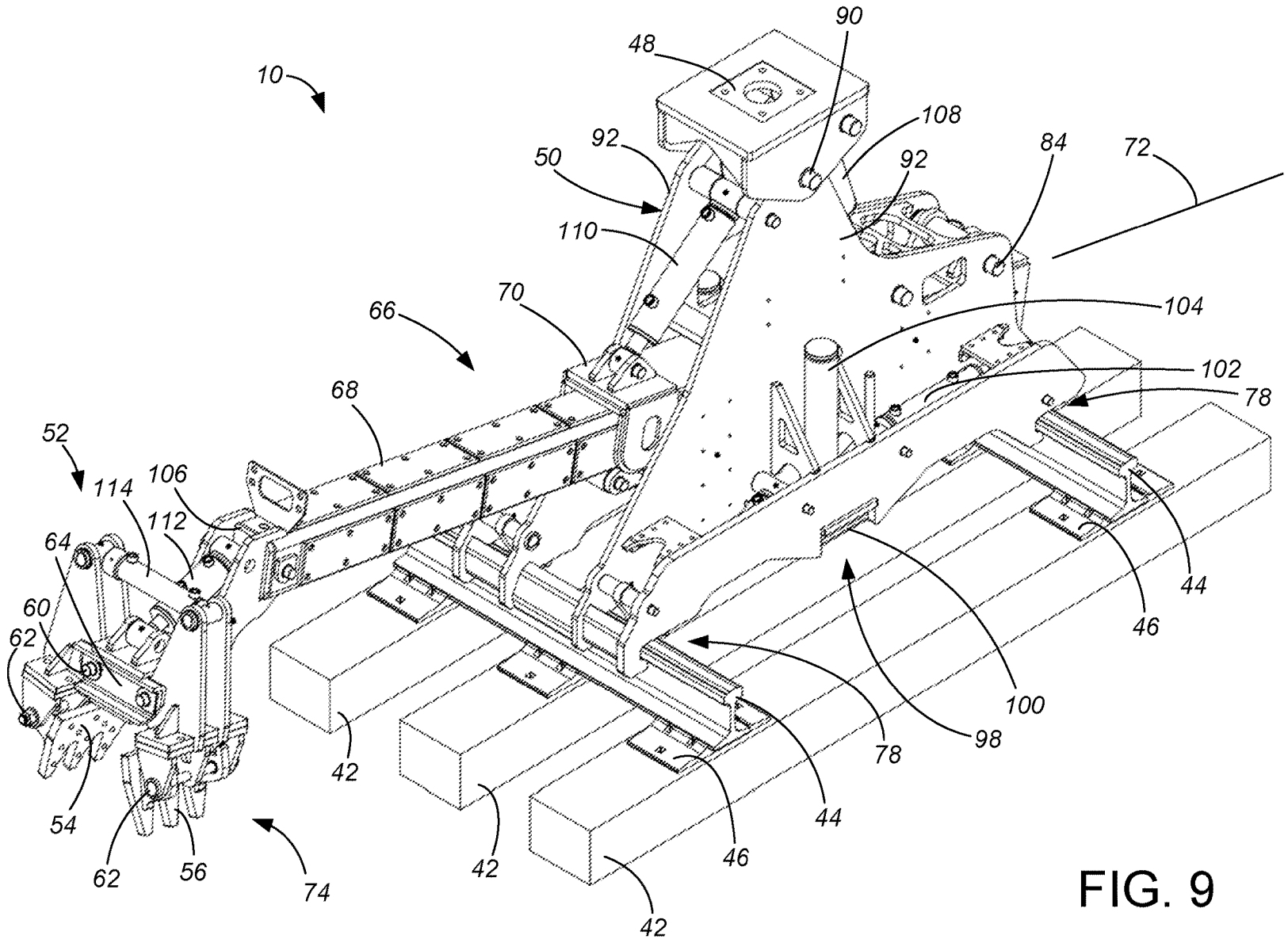
FIG. 9 is a rear perspective view of the railroad tie handler of FIGS. 1-8, with the tie gripper fully extended to the left and with the tie gripper fully opened, not showing the crane or truck, but showing a short section of track.

The present invention is a railroad tie handler, which can be provided as an integral part of a dedicated vehicle or as an aftermarket attachment for a vehicle, as well as a method of using the railroad tie handler. For instance, FIG. 1 shows the preferred railroad tie handler 10 attached to a crane 12 of a tandem axle truck 14. The various component parts of the railroad tie handler 10 are preferably formed mostly or completely from steel or similar high strength metal or composite materials.

The preferred truck 14 has a cab 16 with an engine (not separately shown) with wheels 18 and tires 20 for travelling over pavement. The truck 14 has been separately outfitted with a railroad accessory package, including steel railroad wheels 22 (only one wheel 22 shown, but including four or more preferably eight) which can be lowered and enable the truck 14 to drive on railroad rails instead of over pavement. The preferred truck 14 has a knuckle boom crane 12 for lifting and manipulating many types of loads, powered by hydraulic cylinders 24, using the existing hydraulic flow provided by the truck mounted-PTO driven gear pump (not separately shown). The preferred knuckle boom crane 12 also has a hydraulically powered rotator 26, so a load supported by the crane 12 can be rotated about a substantially vertical axis 28 before being lowered into position by the crane 12. A rear platform 30 on the truck 14 includes steps 32 and a safety cage/fence 34, for a load operator to climb up and safely control the knuckle boom crane 12 from a good viewing elevation atop the platform 30. Controls are available to the load operator at a convenient location such as at the top of the platform 30, such as an electric joystick controller unit 36 powered from the truck's 12-volt electrical system. The truck 14 may include support feet 38, which can be lowered onto the ground to provide a wider stance and additional stability for the crane 12 in cantilevering heavy loads. The truck 14 may include a bed 40, which can be used for transporting new railroad ties and other equipment and supplies (not shown) to a railway job site as well as for transporting old railroad ties from a railway job site.

The preferred railroad tie handler 10 includes a rotator mount with a plate 48, adapted to mounting the tie handler 10 as an attachment directly to the hydraulic rotator 26 that the double jaw grapple (of the prior art described above) is normally mounted to. Because the tie handler 10 is relatively compact and lightweight, it can be easily maneuvered while the mount plate 48 is connected to the hydraulic rotator 26 and crane 12 of the truck 14.

The preferred tie handler 10 is better shown in FIGS. 2-11, depicted relative to a representative rail section that includes three ties 42 (that each could be old ties prior to replacement or alternatively new ties after replacement), two rail portions 44, at a tie plate 46 for connecting each rail 44 to its underlying tie 42. The tie handler 10 includes a main body 50 supporting a tie gripper 52 which is moveable in at least two ways relative to the main body 50. Namely, the tie gripper 52 has a first movement that allows it to compress or otherwise grip or secure to the desired tie 42, and a second movement that changes the position of tie gripper 52 relative to the main body 50 thereby moving the gripped tie 42. The crane 12 with its hydraulic rotator 26 can easily rotate the tie handler 10 about the rotation axis 28 to position the tie gripper 52 either to the right or to the left side (i.e., reversed 180°) of the tie handler 10.

To provide such first gripping movement, the preferred tie gripper 52 includes two gripper jaws 54 each having gripper teeth 56. At least one, and more preferably both gripper jaws 54 are moveable toward or away from opposing side surfaces of a tie 42, which for most ties 42 will involve compressing about the 9 inch wide width of the tie 42. For instance, the preferred jaws 54 each pivot about a gripper jaw pivot axis 58 defined by a gripper jaw pivot pin 60. The two gripper jaw pivot pins 60 are preferably mounted on opposing ends of a gripper arm 64, such as at about 12 inches apart. The preferred gripper jaws 54 each extend downwardly from their pivot pin 60, such as with a length in a range of 4 to 16 inches below the gripper arm 64. The most preferred gripper jaws 54 include three gripper teeth 56 on each jaw 54, with each tooth 56 having a length of about six inches for engagement with the 7 inch high side surface of the tie 42. Since the gripper jaws 54 with their teeth 56 are wear items associated with digging through the gravel ballast, the gripper jaws 54 may be attached with bolts and nuts 62 to facilitate inexpensive replacement.

To provide such second tie-moving movement in one respect, the preferred tie gripper 52 is mounted on the end of a stroker 66, which includes an inner beam 68 sliding telescopingly within an outer tube 70. The orientation of the outer tube 70 of the preferred stroker 66 defines a movement path of the tie gripper 52 which extends linearly about the coincident longitudinal axes 72 of the inner beam 68 and outer tube 70. The inner beam 68 is preferably long enough to provide a significant amount of movement moving the gripped tie 42, such as being able to move the gripped tie 42 within a range of 12 to 120 inches, in the most preferred embodiment having a stroke length of about 48 inches.

To provide the second tie-moving movement in another respect, the preferred tie gripper 52 includes a gripper head 74 which pivots relative to the inner beam 68. The gripper head 74 has a tilt mechanism controlling pivoting about a gripper head pivot pin 76. In the most preferred embodiment, the gripper head pivot pin 76 is located fairly close to the center of the gripper jaws 54, and the full range of tilting only results in a slight lateral movement of the gripped tie 42 such as 1 to 2 inches. Other embodiments can include a much larger length of separating the center of the gripper jaws 54 from the gripper head pivot pin 76, so a full range of tilting results in a more significant lateral movement of the gripped tie 42. Because tilting of the gripper head 74 while gripping a tie 42 results in only a slight lateral movement of the tie 42, the stroker 66 is used as the primary mechanism for moving the gripped tie 42 laterally, and the tilting of the gripper head 74 is primarily used to position the gripper head 74 for digging into the stone/gravel ballast (not shown) and/or to position the gripper jaws 54 at a desired placement location and angle prior to gripping the tie 42.

The preferred main body 50 of tie handler 10 includes a mechanism to bias off one or both rails 44, so the force required to laterally move a gripped tie 42 is not transmitted all the way up to the crane 12, but instead is substantially transmitted to and counteracted by the rails 44. In the preferred embodiment, the main body 50 includes rail clamps 78 each having a rigid hook foot 80, fixed in position relative to the main body 50, which extends downward under the top of the rail 44 to bias off a side of the rail 44. The tie handler 10 then includes opposing rail clamp feet 82 which are used to pinch the opposite side of each rail 44. If desired, the main body 50 could bias off only one rail 44, but more preferably the main body 50 biases off both rails 44. The rigid hook feet 80 are thus preferably positioned about 56.5 inches laterally relative to each other. Further, the preferred rail clamp 78 is not bilaterally symmetrical. Instead, the hooking feet 80 are spaced and oriented to hook around a first side (i.e., either the left side or the right side, but not one of each) of each of two railroad rails 44, such that one of the hooking feet 80 contacts an outer side of one of the railroad rails 44 which the other of the hooking feet 80 contacts an inner side of the other of the railroad rails 44. The clamping feet 82 are moveable relative to the main body 50 and relative to the hooking feet 80, oriented to clamp around a second side of each of the two railroad rails 44, the second side opposing the first side of each railroad rail 44. Because the preferred rail clamp 78 is not bilaterally symmetrical, it is easy to position tie handler 10 using the crane 12 while the clamping feet 82 are fully opened so the hooking feet 80 are adjacent their respective rails 44, and then tighten and close the clamping feet 82 to finally position and secure the main body 50 relative to the rails 44.

The most preferred rail clamp 78 includes four clamping sections, providing four attachment points for the main body 50 similar to a four legged stool. The four clamping sections clamp at first and second spaced locations on one of the rails 44 and at third and fourth spaced locations on the other of the rails 44. The first and second spaced locations are preferably spaced on opposing sides (uprail and downrail sides) of the main body 50, as are the third and fourth spaced location. This again is similar to most four legged stools, where the stool legs contact the floor at spaced locations that are wider than the stool seat. By having these four spaced clamping locations, the clamping mechanism 78 provides a very stable connection between the main body 50 and the two rails 44, helpful both for when the tie handler 10 is set on the rails 44 and for when the tie handler 10 is being used to pull the rails 44 upward.

The preferred tie handler 10 allows moving of the stroker 66 relative to the main body 50, such as by attaching the outer tube 70 to the main body 50 by a stroker pivot pin 84. The stroker 66 can thus pivot about a stroker pivot pin axis 86 to move the gripper head 74 generally upward or downward.

Figure 10:
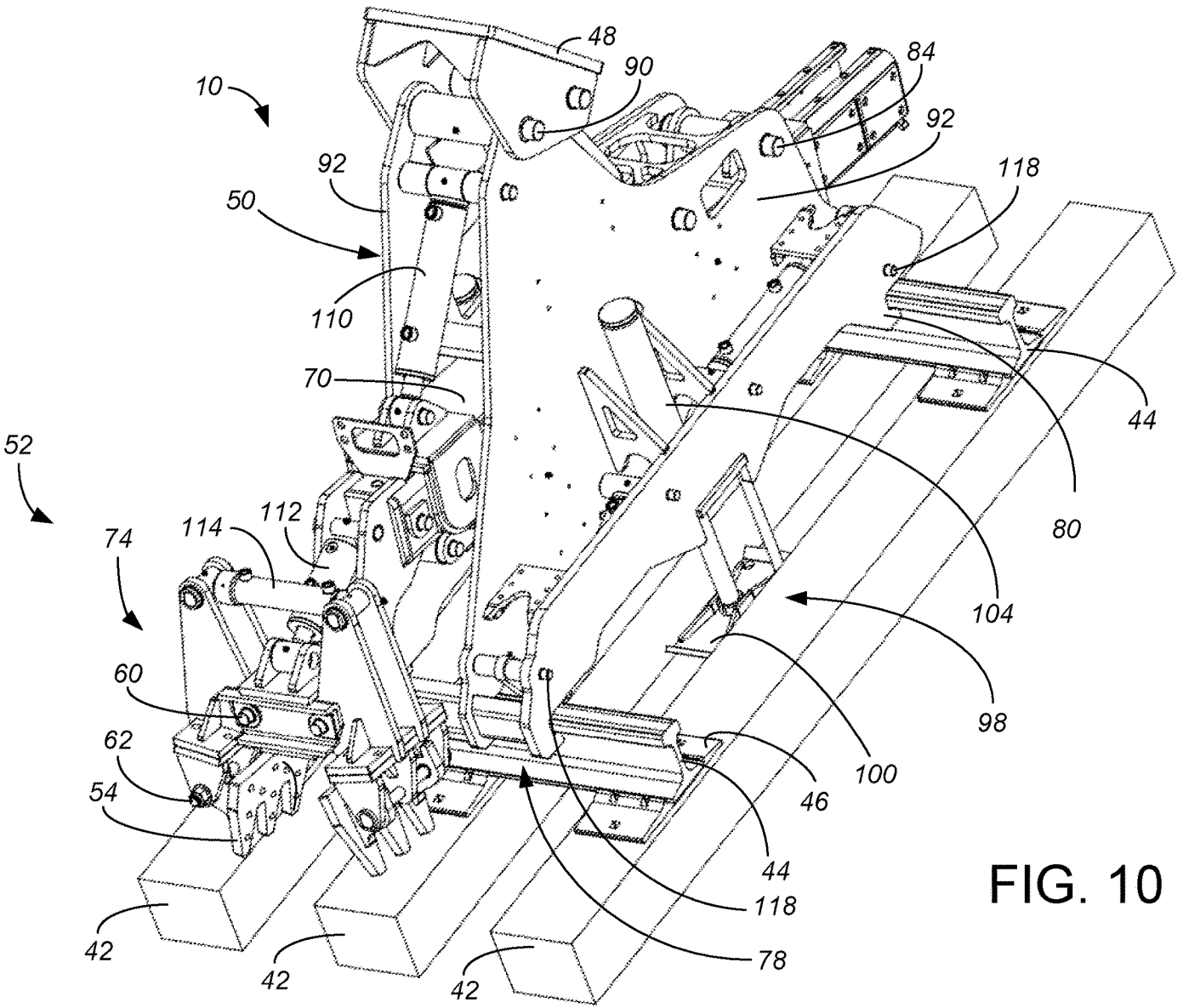
FIG. 10 is a rear perspective view of the railroad tie handler of FIGS. 1-9, with the tie gripper fully extended to the left and with the tie gripper fully opened, not showing the crane or truck, but showing a short section of sloped track and showing how far the rotator mount plate can be angled relative to the main body.
Figure 11:
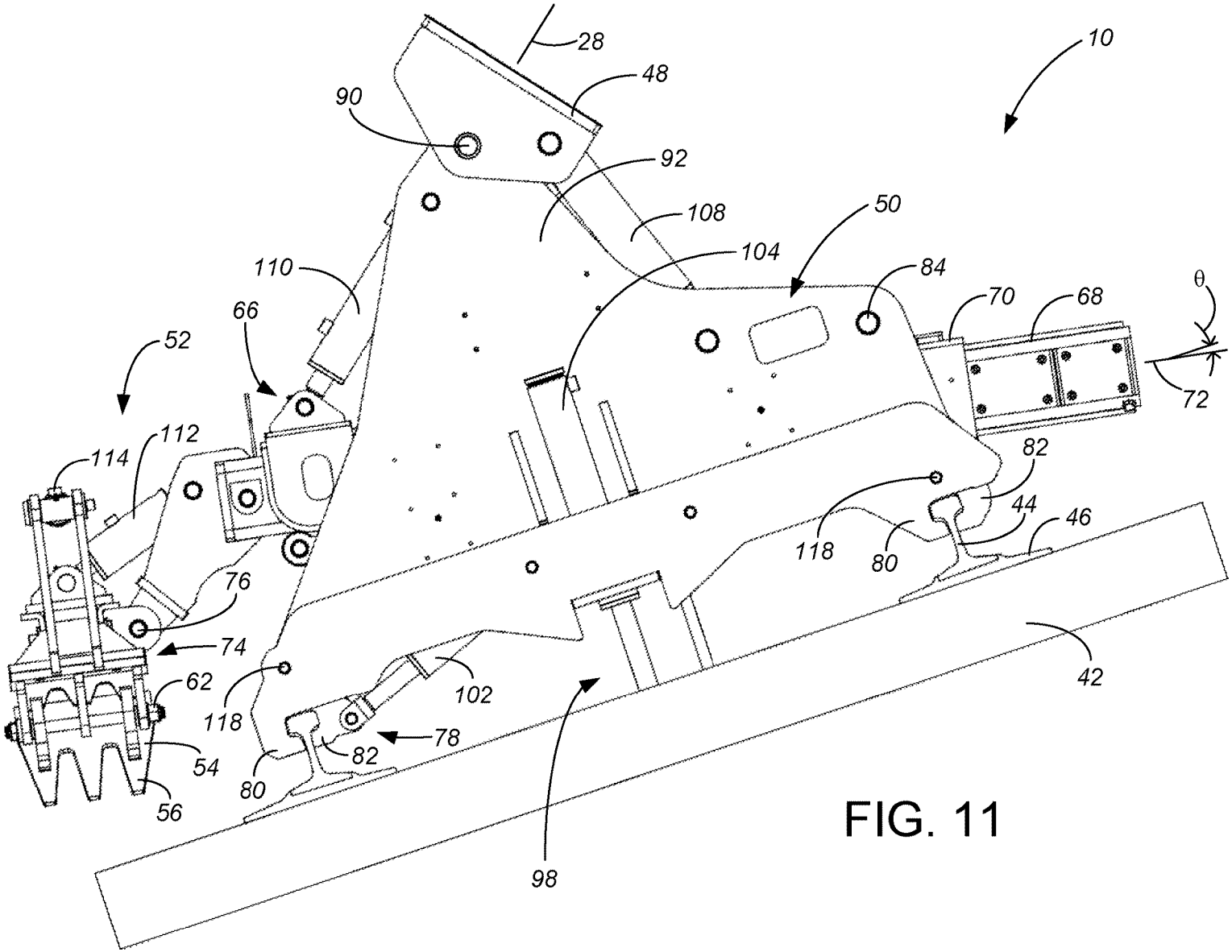
FIG. 11 is a rear elevational view of the railroad tie handler of FIGS. 1-10 in the position of FIG. 10.

The preferred tie handler 10 includes a tilt mechanism, for tilting the main body 50 (and attached gripper head 74 and rail clamp 78) relative to the crane mount plate 48 about a main body pivot axis 88 defined by a main body pivot pin 90. The main body pivot axis 88 is preferably transverse to the rotation axis 28 defined by the crane mount plate 48. The railroad tie handler 10 defines a center of mass which is preferably below the main body pivot axis 88. Tilting of the main body 50 while hanging off the crane 12 is of some use in occasions where the track rails 44 angle as shown in FIGS. 10 and 11. More commonly, the tilting of the main body 50 is very useful in order to better pick up ties 42 from the roadbed ditch line, which can have a significant slope relative to the plane of the rails 44 (and then likely place the used ties 42 on the bed 40 of the truck 14 or position new ties 42 underneath the rails 44). Positioning the main body pivot axis 88 above the center of mass of the tie handler 10 better balances the tie handler 10 when hanging off the crane 12 in a tilted orientation.

The preferred main body 50 is formed by two triangular plates 92, each extending from the main body pivot pin 90 at their top to the rail clamp mechanism 78 at the bottom corners of the triangular plates 92. The plates 92 are disposed on opposing sides of the stroker 66, better balancing the tie handler 10. The two plates 92 provide protection for the stroker 66, and preferably also provide protection for a hydraulic junction box 94. The preferred embodiment includes an opening 96 through one of the plates 92 to make various hydraulic connections and provide access to various hydraulic actuated valves 94.

The preferred tie handler 10 includes at least one raising mechanism 98, with the preferred embodiment including two raising mechanisms 98, both on outer sides of the two triangular plates 92 of the main body 50. Each raising mechanism 98 moves a central support foot plate 100 upwardly or downwardly relative to the main body 50.

The preferred embodiment is hydraulically powered, such as by tapping into the hydraulic power which is available on the truck 14. To make use of the hydraulic power, the preferred embodiment has eleven total hydraulic cylinders in seven hydraulic control circuits: a) four rail clamp cylinders 102; b) two rail lifter cylinders 104; c) a stroker cylinder 106; d) a main body tilt cylinder 108; e) a stroker box pivot cylinder 110; f) a gripper head tilt cylinder 112; and g) a tie gripper cylinder 114. Other embodiments can omit one or more of these hydraulic functions, or add hydraulic functions. The preferred hydraulic cylinders 102, 104, 106, 108, 110, 112, 114 and hydraulic control circuits (not separately shown for simplicity of drawings) are further detailed as follows:

1.) Railhead clamp mechanism 78 (four cylinders 102, each with a 4 inch stroke rated for about 3000 psi/2000 lbs) clamps main body 50 to both rails 44 at four corners of attachment. As called out in FIG. 8, the two cylinders 102*a*, 102*b* toward the gripper head 74 pivot the inner clamping feet 82*a*, 82*b* and the two cylinders 102*c*, 102*d* away from the gripper head 74 pivot the outer clamping feet 82*c*, 82*d*, each controlled foot 82 pivoting about 30 degrees relative to the main body 50 about the axis 116 defined by the foot pivot bolt 118, so the bottom of each associated clamping foot 82 moves laterally within a range of about 4 inches with about 2000 lbs of clamping force.

2.) Stroker box pivot (one cylinder 110 with a 12 inch stroke rated for about 3000 psi/5000 lbs) pivots the outer stroker tube 70 through an angle θ of about plus 30° to minus 15° relative to the main body 50 (shown in FIG. 3 at about minus 2° and in FIG. 4 at about plus 10°) by pivoting about the stroker pivot bolt 84/stroker pivot pin axis 86. The stroker box pivot function allows the gripper mechanism 52 to clear or engage ballast and tie 42, including for digging into the ballast around the tie 42;

3.) Gripper tilt mechanism (one cylinder 112 with a 6 inch stroke rated for about 3000 psi/5000 lbs) pivots the gripper head 74 up to 60° counterclockwise from the position shown in FIG. 3 relative to the inner stroker beam 68 and about the axis of the gripper head pivot pin 76. The gripper tilt function provides rotational movement which is particularly useful in allowing gripper 52 to dig into ballast and for positioning an end of the tie 42 for desired placement under a rail 44;

4.) Tie gripper mechanism 52 (one cylinder 114 with a 6 inch stroke rated for about 3000 psi/3000 lbs) grips a tie 42 for removal or insertion. The tie gripper mechanism 52 pivots the two gripper jaws 54 simultaneously about the two axes 58 defined by the two inner gripper pivot bolts 60, within a range of about 30 degrees from the extended position shown in FIGS. 9 and 10 to the retracted position shown in FIGS. 5 and 8, so the distance between the ends of the opposing gripper teeth 56 can range from about 10 to 3 inches;

5.) Stroker mechanism 66 (one cylinder 106 with a 48 inch throw rated for about 3000 psi/1000 lbs) provides 48" of linear, lateral movement once tie 42 is gripped, for extraction or insertion of tie 42. In the most preferred embodiment, the stroker cylinder 106 when retracted is largely located within the inner beam 68 (which is why inner beam 68 is shown with a forked proximal end), thereby allowing the inner beam 68 to be positioned quite close to the rails 44 without interference and while simultaneously not interfering with either the stroker box pivot cylinder 110 or the main assembly tilt cylinder 108. When extended, the stroker cylinder 106 is largely within the outer tube 70, with its ram largely within the inner beam 68. The stroker cylinder 106 moves the inner stroker beam 68 longitudinally within and sliding relative to the outer stroker tube 70;

6.) Rail lifter 98 (two cylinders 104, each with a 3 inch stroke rated for about 3000 psi/10000 lbs combined) lifts the rails 44 enough to slide tie 42 in or out if tie 42 is hung up on its tie plate 46. The rail lifter cylinders 104 each lower their central base support foot plate 100 up to 3 inches relative to the main body 50; and 7.) Main assembly tilt cylinder 108 (one cylinder 108 with a 10 inch stroke rated for about 3000 psi/5000 lbs) in order to pick up ties 42 from the roadbed ditch line. The main assembly tilt cylinder 108 provides 50° of rotation of the main body 50 (plus or minus 25° from the position shown in FIGS. 2-9 to the position shown in FIGS. 10 and 11, or tilted to the opposite side), rotating the main body 50 and all the attached components relative to the rotator mount plate 48 about the axis 88 defined by the main body pivot bolt 90).

Each of these cylinders 102, 104, 106, 108, 110, 112, 114 is preferably hydraulically plumbed through the valve box 94 to be controller by the electric joystick controller 36.

Hydraulic Circuit:

As mentioned, all mechanical motion of the railroad tie handler attachment 10 is preferably powered by the truck mounted hydraulic pump (not shown). The flow from the pump is directed through a diverter valve (not shown) to the railroad tie handler 10 each time a signal is received when a joystick control button is actuated. A seven-section hydraulic control valve 94 is mounted inside the main body 50 of the railroad tie handler 10. Extra pressure and return lines (not shown) are run from the truck 14 to the railroad tie handler 10 to supply the seven-section control valve 94 and each of the seven preferred hydraulic circuits.

Typical Production Sequence:

Manipulation of the electric joystick controller unit 36 allows the operator to perform multiple functions including: Tie removal, tie insertion, moving used ties 42 to a desired location and retrieving new ties 42 from anywhere the knuckle boom loader will reach, whether that is on the incline of the roadbed or from the bed 40 of the truck 14. A typical production sequence using the preferred embodiment of the inventive railroad tie handler 10 is as follows:

1.) With the railroad tie handler 10 properly mounted on the boom loader 12 as shown in FIG. 1 to replace the double jaw grapple, the operator will ensure all railhead clamp cylinders 102 are retracted.

2.) The stroker box pivot cylinder 110 will also be in the retracted position.

3.) The operator will position the tie handler 10 centered over a tie 42 to be replaced, positioned directly in back of the truck 14 with the truck 14 and platform 30 positioned for best operator visual on the work area. In the preferred truck 14, there is a creep mode on the truck 14 from the loader operator's platform 30 to allow for best positioning. The rotator 26 of the crane 12 is used to pivot the tie handler 10 about axis 28 so the tie handler 10 is in the desired orientation with the gripper head 74 either to the right or the left, and with the stroke direction oriented transverse to the rails 44.

4.) The operator will lower the tie handler 10 so the fixed hooking feet 80 make contact or nearly make contact with the two rails 44.

5.) The stroker box pivot cylinder 110 will be extended to put the gripper fingers near the tie surface to allow operator to center the gripper jaws 54 on the old tie 42 and move the assembly 10 as necessary with the truck 14 and crane 12 to center on the old tie 42.

5.) The operator will clamp the clamping feet 82 to lock onto the two rails 44, fixing the main body 50 securely to both rails 44.

6.) The stroker pivot and gripper tilt cylinders 110, 112 will be used together as needed to allow the gripper teeth 56 to penetrate the ballast 5 to 6 inches along the tie sides.

7.) When the gripper head 74 has been lowered to a visually acceptable depth, the gripper cylinder 114 is actuated to grip the old tie 42.

8.) After old tie 42 is securely gripped, force from the stroker cylinder 106 will break the old tie 42 loose from the ballast and move the old tie 42 out from under the rails 44 in a direction perpendicular to the run of the rails 44. When the stroker cylinder 106 is fully stroked out (48 inches), the operator will release the gripper 52 and fully retract the stroker cylinder 106. When fully retracted, the operator will again engage the gripper 52 to grip the old tie 42. When gripped, the operator will run a second cycle of the stroker cylinder 106, removing the old tie 42 fully from under the rails 44. The operator will then maneuver the crane 12 to drop the old tie 42 on the truck bed 40 or otherwise away from the work area so it doesn't interfere with reinsertion of a new tie 42. With tie length typically being about 102 inches including about 20 inches on each end beyond the rails 44, a tie movement of about 82 inches is typically necessary to fully remove the old tie 42 from under the rails 44, amply provided by two strokes totaling 96 inches of lateral tie movement.

9.) Occasionally the tie plates 46 will wear into the old tie 42 forming a shoulder that is difficult to pull the old tie 42 past because the tie plate 46 is engaged to the rail 44 and the bottom of the plate 46 is sunk into the old tie 42. In these cases, it is necessary to lift the rail 44 to form clearance to remove the tie plate 46 and/or old tie 42. As necessary, with the rail clamps 78 actuated and the tie gripper 52 released, the rail lifter 98 can be actuated extending the vertical cylinders 104 located centrally between the rails 44 in the front and rear of the railroad tie handler 10. When the railroad tie handler 10 is centered a tie 42, the rail lifter feet 100 will typically be located over the stone/gravel ballast between ties 42. With the rail 44 lifted, the old tie 42 (and/or tie plate 46 by a worker) can be pulled out.

Tie Insertion:

1.) The operator will maneuver the crane 12 to position the tie handler 10 over a new tie, extend the main body tilt cylinder 108, the stroker box pivot cylinder 110 and/or the gripper head tilt cylinder 112 to lower the gripper head 74 as low as possible/needed, and pick up a new tie with the gripper jaws 54. The operator then maneuvers the crane 12 to (perhaps with the aid of a worker) position an end of the new tie 42 under a nearside rail 44 in the void left from removing the old tie 42, sliding the tie 42 in as far as possible through crane movement. The main body tilt cylinder 108, the stroker box pivot cylinder 110 and/or the gripper head tilt cylinder 112 can be used to properly position the entry end of the new tie 42. After an end of the tie 42 is under one rail 44, the gripper jaws 54 can release the new tie 42. The operator then lifts and swings the tie handler 10 to center the tie handler 10 on the new tie 42, returns the main body tilt cylinder 108 so the tie handler 10 is horizontal and/or parallel to any rail slope, and lowers the tie handler 10 positioning the fixed railhead hooks back to the two rails 44. Once in or nearly in position with the tie handler 10 resting on the rails 44, the operator tightens the clamping feet 82, securing the tie handler 10 to both rails 44.

2.) The operator then extends the stroker cylinder 106 to full extension.

3.) The operator adjusts the stroker box pivot cylinder 110 to set the correct tooth depth of the jaws 54 relative to the new tie 42.

4.) The operator actuates the gripper cylinder 114 to (now for a second time) grip the new tie 42.

5.) The operator then retracts the stroker cylinder 106 its full stroke (48"), pulling/pushing the new tie 42 laterally inward, including threading end of the new tie 42 into the void under the second rail 44.

6.) The operator releases the gripper 52.

7.) The operator again extends the stroker cylinder 106 to full extension.

8.) The operator actuates the gripper jaws 54 again (now for a third time) onto the new tie 42.

9.) The operator retracts the stroker cylinder 106, pulling/pushing the new tie 42 laterally to the desired final position.

10.) Workers place tie plates 46 on the new tie 42, under each of the rails 44, possibly while the operator is extending the lifter cylinders 104 to pull upwardly on the rails 44.

11.) The operator retracts the lifter cylinders 104, and workers manually tamp gravel ballast under and around the newly placed tie 42 to hold the newly placed tie 42 in place, possibly while the operator manipulates the main body tilt cylinder 108, the stroker box pivot cylinder 110 and/or the gripper head tilt cylinder 112 to pull up on the new tie 42.

12.) The operator releases the gripper 52, and uses the crane 12 to move the tie handler 10 out of the way.

13.) Workers spike the tie plate 46 to the tie 42, and manually tamp the ballast to the desired level.

While the above explanation details a common production sequence, the various cylinders 102, 104, 106, 108, 110, 112, 114 of the tie handler 10, as well as the crane movement and rotation, can be controlled by the operator in a myriad of different sequential steps to handle removal and insertion of ties 42 in many different scenarios.

The present invention fills a niche that is currently void. It increases the usefulness of the loader truck 14 and increases productivity of track maintenance by a multiple to be determined during usage, particularly as operators become proficient at controlling the various hydraulic cylinder movements. Providing the railroad tie handler 10 as an attachment to replace the prior art grapple capitalizes on the power system from the existing truck 14 and offers an expedient lower cost alternative to a self-powered machine to do the same work. The invention adds safety by reducing hand labor needed for the task of tie removal and insertion, and also increases production significantly in order to justify the cost of the railroad tie handler 10.

Although the present invention has been described with reference to preferred embodiments, workers skilled in the art will recognize that changes may be made in form and detail without departing from the spirit and scope of the invention. In particular, the dimensions and materials listed are exemplary only unless listed in a particular claim.

The invention claimed is:

1. A railroad tie handler comprising:

a crane rotator mount;

a main body pivotally attached below the crane rotator mount, the main body being able to pivot about a main body pivot axis relative to the crane rotator mount;

a tie gripper supported by the main body via a stroker that allows the tie gripper to be selectively extended or retracted relative to the main body, the tie gripper being adapted for selectively gripping a railroad tie; and a rail clamp supported by the main body, which is adapted for selectively clamping the main body relative to rails of a railroad section;

wherein the railroad tie handler defines a center of mass which is below the main body pivot axis:

wherein the stroker and the tie gripper are hydraulically powered, and further comprising:

a main body tilt hydraulic cylinder, wherein the main body tilt hydraulic cylinder can extend or retract to change the tilt angle of the main body relative to the crane rotator mount.

2. The railroad tie handler of claim 1, wherein the stroker and the tie gripper are hydraulically powered, and further comprising:

a rail lifting hydraulic cylinder, wherein, when the rail clamp is clamping the main body relative to rails of a railroad section, the rail lifting hydraulic cylinder can extend to bias a ground location underneath the rails downwardly relative to the rails, so as to place a lifting force tending to lift the rails relative to the underlying ground.

3. The railroad tie handler of claim 2, wherein the rail lifting hydraulic cylinder is vertically oriented and aligned vertically beneath the main body pivot axis.

4. The railroad tie handler of claim 1, wherein the rail clamp comprises:

two hooking portions which are fixed relative to the main body, the hooking portions being spaced and oriented to hook around a first side of each of two railroad rails, such that one of the hooking portions contacts an outer side of one of the railroad rails while the other of the hooking portions contacts an inner side of the other of the railroad rails; and two clamping portions which are moveable relative to the main body and relative to the hooking portions, oriented to clamp around a second side of each of the two railroad rails, the second side opposing the first side of each railroad rail.

5. The railroad tie handler of claim 1, wherein the main body comprises two spaced plate portions with the stroker extending between the spaced plate portions.

6. The railroad tie handler of claim 1, wherein the rail clamp comprises four clamping sections, each clamping section having at least one clamping portion which is moveable relative to the main body, for clamping at first and second spaced locations on one of the rails and clamping at third and fourth spaced locations on the other of the rails.

7. The railroad tie handler of claim 1, wherein the main body has a triangular shape, extending between the main body pivot axis at a top of the triangular shape and two rail clamping locations at a bottom of the triangular shape.

8. The railroad tie handler of claim 1, wherein the crane rotator mount comprises a horizontally extending mounting plate, and wherein a crane supporting the crane rotator mount allows rotation about a substantially vertical rotation axis.

9. The railroad tie handler of claim 1, wherein the stroker defines a stroking movement path of the tie gripper relative to the main body, and further comprising:

a gripper tilt mechanism, which selectively allows tilting of the tie gripper relative to the stroking movement path.

10. A railroad tie handler comprising:

a main body;

a tie gripper supported by the main body via a stroker that allows the tie gripper to be selectively extended or retracted relative to the main body, the tie gripper being adapted for selectively gripping a railroad tie, wherein the stroker defines a stroking movement path of the tie gripper relative to the main body;

stroker; and a rail clamp supported by the main body, which is adapted for selectively clamping the main body relative to rails of a railroad section; and a gripper tilt mechanism, which selectively allows tilting of the tie gripper relative to the stroking movement path.

11. The railroad tie handler of claim 10, wherein the rail clamp comprises four clamping sections, each clamping section having at least one clamping portion which is moveable relative to the main body, for clamping at first and second spaced locations on one of the rails and clamping at third and fourth spaced locations on the other of the rails.

12. The railroad tie handler of claim 11, wherein the first and third spaced locations define a location of a first vertical clamping plane, wherein the second and fourth spaced locations define a location of a second vertical clamping plane, and wherein the stroker is located between the first and second vertical clamping planes.

13. The railroad tie handler of claim 10, wherein the main body has a triangular shape, extending between a crane mount at a top of the triangular shape and two rail clamping locations at a bottom of the triangular shape.

14. A method of handling a railroad tie extending transversely under two rails of a railroad track, comprising:

clamping a main body of a railroad tie handler onto the two rails;

lifting the rails by biasing a ground location underneath and between the rails downwardly relative to the rails, so as to place a lifting force tending to lift the rails relative to the underlying ground;

gripping a tie extending transversely under the two rails with a tie gripper; and extending or retracting a stroker supporting the tie gripper from the main body, thereby moving the tie transversely relative to the rails.

15. The method of claim 14, wherein clamping the main body onto the two rails comprises clamping at four spaced locations on the two rails.

16. The method of claim 14, wherein the main body is pivotally attached below a crane rotator mount, and further comprising extending or retracting a main body tilt mechanism to change the tilt angle of the main body relative to the crane rotator mount.

17. The method of claim 14, wherein the stroker defines a stroking movement path of the tie gripper relative to the main body, and further comprising tilting of the tie gripper relative to the stroking movement path.

18. The method of claim 14, wherein the railroad tie handler comprises a crane mount which attached the railroad tie handler to a crane, and further comprising moving the railroad tie handler with the crane.

19. The method of claim 18, wherein the crane is supported on a truck, the truck being adapted to travel over pavement and separately adapted to travel over the rails, and further comprising moving the truck both over the rails and over pavement.

20. A railroad tie handler comprising:

a main body;

a tie gripper supported by the main body via a stroker that allows the tie gripper to be selectively extended or retracted relative to the main body, the tie gripper being adapted for selectively gripping a railroad tie; and a rail clamp supported by the main body, which is adapted for selectively clamping the main body relative to rails of a railroad section, wherein the rail clamp comprises:

two hooking portions which are fixed relative to the main body, the hooking portions being spaced and oriented to hook around a first side of each of two railroad rails, such that one of the hooking portions contacts an outer side of one of the railroad rails while the other of the hooking portions contacts an inner side of the other of the railroad rails; and two clamping portions which are moveable relative to the main body and relative to the hooking portions, oriented to clamp around a second side of each of the two railroad rails, the second side opposing the first side of each railroad rail.

* * * * *